US008230919B2

(12) United States Patent
Goodwin et al.

(10) Patent No.: US 8,230,919 B2
(45) Date of Patent: Jul. 31, 2012

(54) WELL THERMAL INSULATION FOR FORMATION SAMPLING OF VISCOUS FLUIDS AND METHODS OF USE THEREOF

(75) Inventors: Anthony Goodwin, Sugar Land, TX (US); Carlos Abad, Richmond, TX (US); Amy Simpson, The Hague (NL)

(73) Assignee: Schlumberger Technology Corporation, Sugar Land, TX (US)

( * ) Notice: Subject to any disclaimer, the term of this patent is extended or adjusted under 35 U.S.C. 154(b) by 325 days.

(21) Appl. No.: 12/354,190

(22) Filed: Jan. 15, 2009

(65) Prior Publication Data

US 2009/0151937 A1 Jun. 18, 2009

Related U.S. Application Data

(60) Provisional application No. 61/023,952, filed on Jan. 28, 2008.

(51) Int. Cl.

| | |
|---|---|
| ***E21B 47/00*** | (2006.01) |
| ***E21B 49/00*** | (2006.01) |
| ***E21B 49/08*** | (2006.01) |
| ***E21B 49/10*** | (2006.01) |
| ***E21B 36/00*** | (2006.01) |
| ***E21B 43/24*** | (2006.01) |

(52) U.S. Cl. ..... 166/250.17; 166/302; 166/57

(58) Field of Classification Search ..... 166/250.17, 166/264, 302, 303, 57; 175/59; 73/152.13, 73/182.12, 152.24, 152.33

See application file for complete search history.

(56) References Cited

U.S. PATENT DOCUMENTS

| | | | | |
|---|---|---|---|---|
| 3,713,488 | A | 1/1973 | Ellenburg | |
| 4,137,970 | A | 2/1979 | Laflin et al. | |
| 4,766,955 | A | 8/1988 | Petermann | |
| 4,860,581 | A | 8/1989 | Zimmerman et al. | |
| 4,877,542 | A | 10/1989 | Lon et al. | |
| 4,881,406 | A | 11/1989 | Coury | |
| 4,936,139 | A | 6/1990 | Zimmerman et al. | |
| 5,302,781 | A | 4/1994 | Hanson, III | |
| 5,494,106 | A | 2/1996 | Gueguen et al. | |
| 5,607,901 | A | 3/1997 | Toups, Jr. et al. | |
| 5,677,267 | A | 10/1997 | Suarez et al. | |
| 5,803,186 | A * | 9/1998 | Berger et al. | 175/50 |

(Continued)

FOREIGN PATENT DOCUMENTS

| | | |
|---|---|---|
| GB | 2431673 | 5/2007 |

(Continued)

OTHER PUBLICATIONS

Meyer, R.F. et al., Natural Bitumen and Extra Heavy Oil, Ch. 4, 2004, Survey of Energy Resources, J. Trinnaman and A. Clarke Eds. for the World Energy Council, Elsevier, Amsterdam, 2004, p. 93-117.

(Continued)

*Primary Examiner* — Cathleen Hutchins
(74) *Attorney, Agent, or Firm* — David J. Smith

(57) ABSTRACT

Evaluating a subterranean formation fluid by lowering a testing tool to a depth in a wellbore formed in a subterranean formation, limiting wellbore fluid convection near the depth with the testing tool, heating formation fluid in the subterranean formation near the depth, obtaining a sample of the heated formation fluid from the subterranean formation, and evaluating at least a portion of the sample of heated formation fluid obtained from the subterranean formation.

8 Claims, 4 Drawing Sheets

U.S. PATENT DOCUMENTS

| | | | | |
|---|---|---|---|---|
| 5,902,939 | A | 5/1999 | Ballard et al. | |
| 6,343,652 | B1 | 2/2002 | Corre et al. | |
| 6,786,086 | B2 * | 9/2004 | Hashem | 73/152.41 |
| 6,908,886 | B2 | 6/2005 | Jones et al. | |
| 6,914,804 | B2 | 7/2005 | Leslea | |
| 7,036,585 | B2 | 5/2006 | Zhou et al. | |
| 7,252,142 | B2 | 8/2007 | Brezinski et al. | |
| 7,392,851 | B2 | 7/2008 | Brennan, III et al. | |
| 2003/0226663 | A1 | 12/2003 | Krueger et al. | |
| 2004/0089475 | A1 | 5/2004 | Kruspe et al. | |
| 2005/0092485 | A1 * | 5/2005 | Brezinski et al. | 166/207 |
| 2007/0215348 | A1 | 9/2007 | Corre et al. | |
| 2008/0066904 | A1 | 3/2008 | Van Hal et al. | |
| 2008/0078581 | A1 | 4/2008 | Goodwin et al. | |

FOREIGN PATENT DOCUMENTS

| | | |
|---|---|---|
| WO | WO02057596 | 7/2002 |
| WO | WO03016826 | 2/2003 |

OTHER PUBLICATIONS

Heron, J.J. et al., Ann. Rev. Energy 1983, 8, 137-163.
Oblad, A.G. et al., Ann. Rev. Energy 1987, 12, 283-356.
Speight, J.G., Ann. Rev. Energy 1986, 11, 253-274.
Ovalles, C., Fuel 1995, 74, 1162-1168.

* cited by examiner

WELL THERMAL INSULATION FOR FORMATION SAMPLING OF VISCOUS FLUIDS AND METHODS OF USE THEREOF

CROSS-REFERENCE TO RELATED APPLICATIONS

This application claims the benefit of U.S. Provisional Application No. 61/023,952, entitled "WELL THERMAL INSULATION FOR FORMATION SAMPLING OF VISCOUS FLUIDS," filed Jan. 28, 2008, the disclosure of which is hereby incorporated herein by reference.

This application is also a Continuation-In-Part application claiming the benefit of U.S. application Ser. No. 11/755,039, entitled "METHODS AND APPARATUS TO SAMPLE HEAVY OIL FROM A SUBTERRANEAN FORMATION," filed May 30, 2007, the disclosure of which is hereby incorporated herein by reference.

BACKGROUND OF THE DISCLOSURE

Underground reservoirs may contain hydrocarbons having a viscosity in excess of approximately 100 cP at reservoir temperature. The testing operations (e.g., fluid sampling) in such reservoirs may benefit from the mobility of the hydrocarbon being reduced prior to or during hydrocarbon extraction from the reservoir. In some cases (e.g., the reservoir contains hydrocarbons that are liquids at reservoir temperature, that is, the hydrocarbons have a viscosity value lower than about 10,000 cP), the mobilization of reservoir fluids may be effected by increasing locally the formation temperature close to a sampling port. Increasing the formation temperature reduces the viscosity and results in a more mobile fluid, and thereby expediting testing operations.

For all forms of heating, there is limited power available downhole, for example, on the order of 10 kW. If thermal convection in the wellbore is low, this power may be sufficient compared to the power required to increase the temperature of a formation. For example, in the absence of heat convection in the wellbore, prior results indicate that a resistive heater forced to contact the wellbore wall and having a power of about 0.5 kW may elevate the formation fluid temperature locally by about 100° C. without giving rise to significant thermal degradation of the hydrocarbon.

In some cases, however, heat convection may be significant and may even prevent adequate heat transfer to the formation. Indeed, the convection may lead to significant loss of heat in the wellbore fluid, away from the zone of the formation to be heated. This may be particularly the case when using surface heating wherein heat may be transferred from a hot surface provided by a downhole testing tool, through the wellbore fluid, and to the formation. Heat convection may also be particularly significant in vertical wells. It will be appreciated that vertical uncased wells are more prevalent than horizontal and cased holes during exploration and appraisal stages of hydrocarbon reservoir evaluation, particularly in the case of heavy oil reservoirs which may be found within less than 1000 m of the surface.

The propensity for natural convection may be determined by the Grashof number, which approximates the ratio of the buoyancy to viscous force acting on a fluid. The Grashof number Gr is defined by Equation 1 below:

$$G_r = \frac{g(T_{heater} - T_{res})L^2}{\langle\eta\rangle^2}\left\{-\frac{1}{\rho}\left(\frac{\partial\rho}{\partial T}\right)_p\right\} \quad \text{Equation 1}$$

In Equation 1, g is the acceleration of free-fall and is a constant. As indicated by Equation 1, the propensity for natural convection depends on the physical properties of the wellbore fluid, which will presumably be some form of drilling lubricant, through <η> the mean kinematic viscosity of the wellbore fluid over the temperature range, and through <−1/ρ (∂ρ/∂T)p> the mean volumetric thermal expansion of the wellbore fluid over the temperature range. As indicated by Equation 1, the propensity for natural convection also depends on the heating configuration through $T_{heater}$ and $T_{res}$, the temperatures of the heater and wellbore above (which is essentially equal to the reservoir), respectively, and through L, a characteristic length, for example the distance between the heater and the formation. For a reservoir at a temperature of 20° C. and at and a pressure of 14 MPa, and for a heater at a temperature of 120° C., the values of the Grashof number taken for water- and oil-based muds suggest the buoyancy force is sufficient for significant convection in the wellbore. Convection may in turn lead to a significant energy loss into the wellbore fluid.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
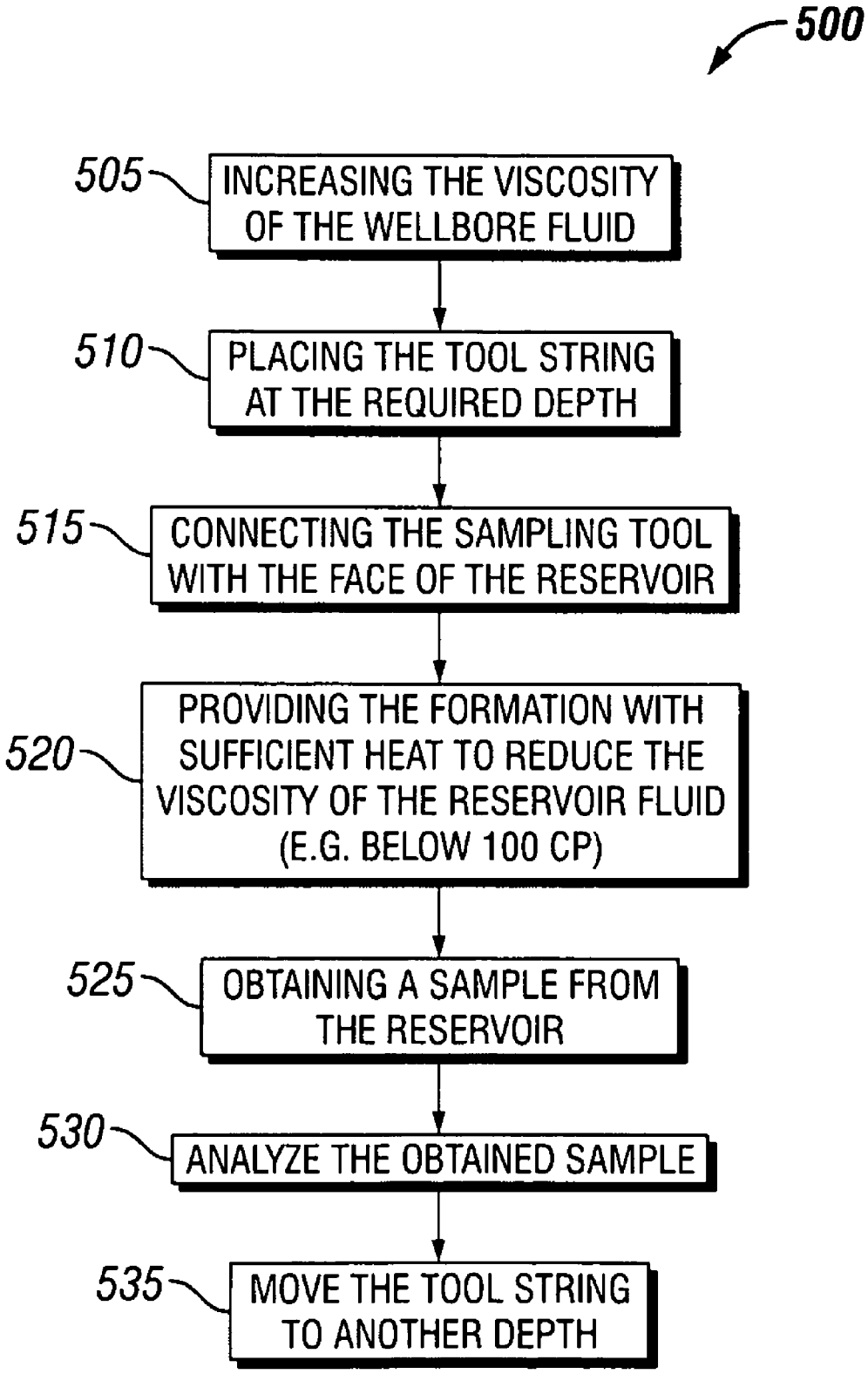
FIG. 1 is a flow chart diagram of at least a portion of a method according to one or more aspects of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

One or more aspects of the apparatus and/or methods within the scope of the present disclosure may be used to evaluate reservoirs that contain heavy oils or bitumen (e.g., hydrocarbons having an API gravity value lower than approximately 20°), including heavy oils that are liquids at reservoir temperature (e.g., having a viscosity value lower than approximately 10,000 cP).

A barrier configured to reduce heat convection in the wellbore according to one or more aspects of the present disclosure may be provided with a high viscosity fluid introduced in the wellbore prior to the heating and testing operations with a downhole tool. For example, the concentration of bentonite in the drilling fluid may be increased. The high viscosity fluid may be a non-Newtonian fluid, as determined by its response to shear stress as a function of frequency.

A barrier configured to reduce heat convection in the wellbore according to one or more aspects of the present disclosure may also or alternatively be provided with a packer positioned above or otherwise near the heater of a downhole testing tool. The packer structure may be similar to the structure of known packers used in traditional testing tools (e.g., an inflatable packer).

A barrier configured to reduce heat convection in the wellbore according to one or more aspects of the present disclosure may also or alternatively be provided with a high viscosity gel set above or otherwise near the heater of a downhole testing tool. The gel may be formed from a reaction that occurs when two fluids are mixed downhole. The gelling reaction may be reversible to the extent the gel reverts to a liquid by mechanical agitation, addition of a chemical, or otherwise.

FIG. 1 is a flow chart diagram of at least a portion of a method 500 of evaluating hydrocarbon fluid via formation heating. Generally, the method 500 comprises increasing the wellbore fluid viscosity to reduce heat convection that may occur during heating of the formation. Thermal insulation may be provided in the well in such a manner as to enable and/or expedite the mobilization of formation fluid with a downhole heat source having a limited power.

At step 505, a high viscosity wellbore fluid may be introduced in the wellbore to reduce heat convection that may occur during subsequent heating of a portion of the formation. Equation 1 (above) shows that the Grashof number can be significantly increased, and the heat convection decreased, by increasing the viscosity of the wellbore fluid. Thus, a high viscosity wellbore fluid reduces fluid movement in the wellbore and provides a barrier to natural heat convection.

The high viscosity fluid may be introduced in the wellbore by mixing additives with the drilling fluid, for example, and circulating the fluid through the drilling fluid. Alternatively, the drill string may be removed from the wellbore and a work string having a mud passageway therein may be lowered in the well. The high viscosity wellbore fluid may then be circulated in the well.

In addition to its viscosity properties, the wellbore fluid introduced in the wellbore at step 505 may also be selected based on its thermal properties. Selecting a wellbore fluid having a low thermal diffusivity may further reduce heat diffusion in the wellbore fluid that may occur when a portion of the formation is heated. For example, the thermal conductivity and heat capacity of oil are, respectively, factors of 2 and 5 lower than those of water at a temperature of 120° C. Therefore, the thermal diffusivity is a factor of 2.6 lower for oil than water. Based on these values, oil may be the preferred base fluid for the high viscosity wellbore fluid.

The viscosity of the wellbore fluid may be increased by adding bentonite to the wellbore fluid. The amount of bentonite added to the wellbore fluid may be controlled so as to not excessively increase the density of the drilling fluid. Increasing the density of the wellbore fluid increases the wellbore pressure and consequently the amount of mud filtrate that may seep into the formation. An excessive mud filtrate invasion may compromise subsequent sampling of pristine formation fluid. Moreover, while the use of bentonite for increasing the wellbore fluid viscosity has been described, other wellbore fluids may also or alternatively be used, as described in U.S. Pat. Nos. 4,877,542; 5,677,267; 5,607,901; and 6,908,886.

To evaluate hydrocarbon reservoirs, a testing tool may be conveyed downhole at step 510. The testing tool may be conveyed by wire-line, drill-pipe, tubing and/or any other means used in the industry. In one particular example, the testing tool may be part of the work string used to introduce a high viscosity fluid in the wellbore (e.g., at step 505). When a sampling port of the testing tool is located at the depth at which a hydrocarbon is to be tested, the testing tool may be anchored and a probe may be extended toward the wellbore wall, thereby fluidly connecting the testing tool with the face of the reservoir at step 515.

The method chosen to mobilize the reservoir hydrocarbon to permit sampling should either provide an aliquot with a composition that represents the important characteristics of the reservoir fluid sufficiently well or any changes to the physical characteristics of the hydrocarbon that arise during the sampling and are reversible. Therefore, at step 520, increasing the temperature of the formation near a sampling port (e.g., by about 100° C.) may be among the possible means of mobilizing the heavy oils and bitumen. The temperature increase may be further subject to the constraint that the hydrocarbon is maintained at a temperature below that of the bubble pressure. The temperature increase may be further subject to the constraint that the mobilized hydrocarbon should readily flow in the testing tool without causing an excessive pressure drop. Thus, the fluid viscosity may be reduced to a value below 100 cP.

The testing tool may be provided with one or more heating pads (e.g., one or more resistive heating elements) that are applied against the formation. The pads may generate heat that is conducted in a portion of the formation close to a sampling probe. The conducted heat elevates the temperature of the hydrocarbon, thereby reducing its viscosity. The testing tool may alternatively or additionally be provided with electro-magnetic transducers configured to propagate an electromagnetic field in a portion of the formation. Consequently, the electro-magnetic field may generate an inductive or galvanic current in the portion of the formation. Because of the resistance of the formation, the current may be dissipated into heat in the portion of the formation. Accordingly, the temperature of the hydrocarbon may increase, thereby reducing its viscosity. The electro-magnetic field may have frequency components from DC to several GHz.

While electrical heat sources have been discussed above, other heat sources may alternatively or alternatively be used, such as chemical heat sources, for example as disclosed in U.S. Patent Publication No. 2008-0066904. Further, while particular methods of heat delivery to the formation have been discussed above, other delivery methods, including perforating the formation, may also be used. A more detailed description of alternative heat delivery methods can be found for example in U.S. Patent Publication No. 2008-0078581. Additionally, the mobilization of reservoir fluid at step 520 may be effected by injecting a diluent. However, the use of a diluent may result in the precipitation of asphaltenes in the formation, or other undesirable physico-chemical transformation, and the acquisition of an unrepresentative sample.

Regardless of the type of heat source used for heating the formation at step 520, the high viscosity wellbore fluid provided at step 505 reduces heat convection that may occur during the step 520. Thus, the thermal insulation provided in the well may enable and/or expedite the mobilization of formation fluid with the downhole heat source. As thermal convection in the wellbore is reduced, the downhole heat source may suffice to rapidly increase the temperature of the formation to a desired level.

The testing tool may then be used to take one or more samples from the reservoir formation at step 525. The samples should be representative of the formation hydrocarbon, and may be substantially free of solid in suspension (mostly sand) and drilling fluid, so that the samples can be used to determine the chemical and physical properties of the reservoir hydrocarbon (for example, at a location downhole, during subsequent step 530). The chemical and physical properties may be used, for example, to assist with the definition of a suitable production strategy. When testing at the depth selected at step 510 is completed, the testing tool may be moved to another depth or removed from the wellbore at step 535.

Figure 2:
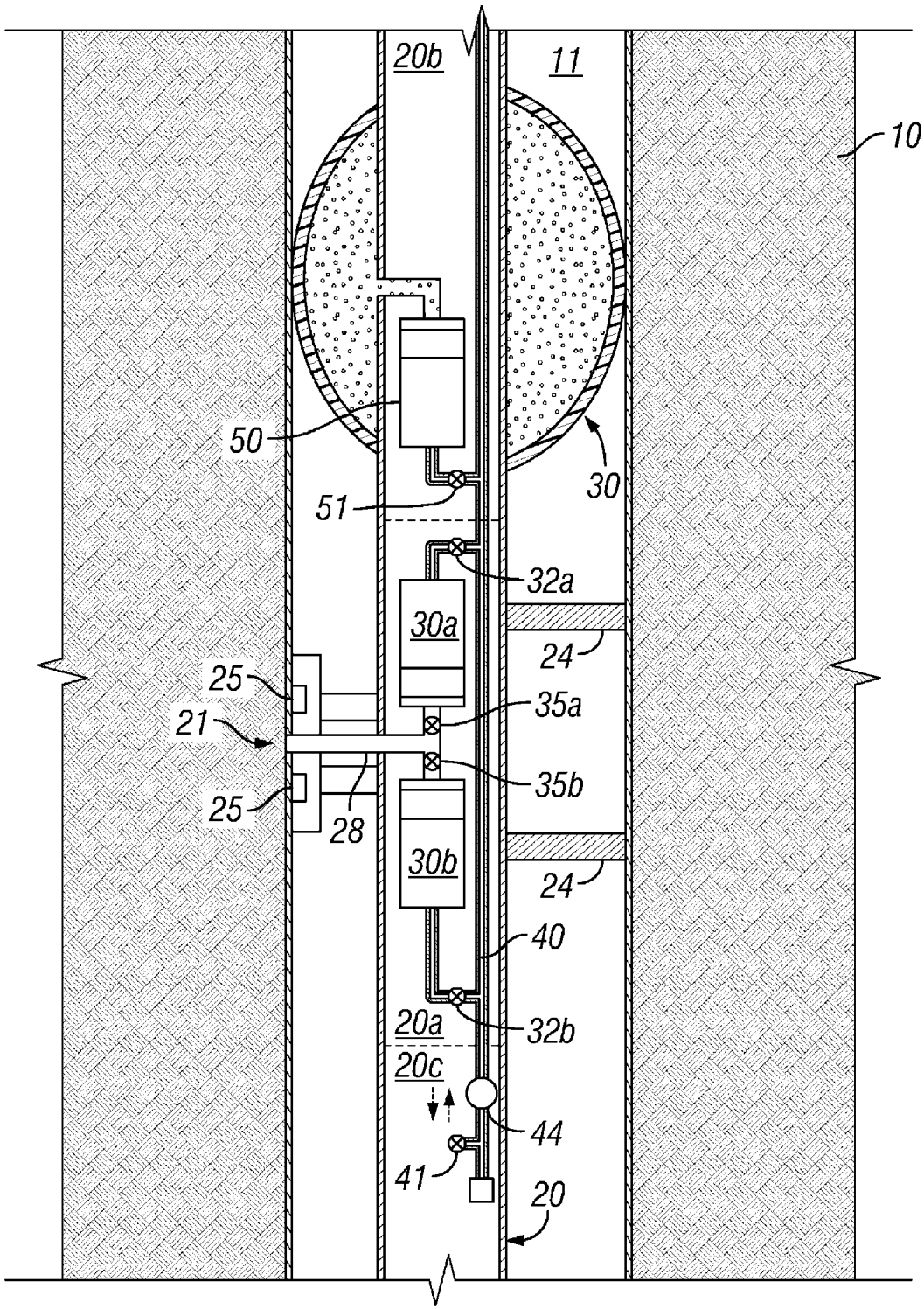
FIG. 2 is a schematic view of at least a portion of an apparatus according to one or more aspects of the present disclosure.

Referring to FIG. 2, illustrated is a schematic view of at least a portion of a testing tool 20 lowered in a wellbore 11. The testing tool 20 comprises an inflatable packer 30 configured to reduce heat convection in the well during fluid evaluation operations. The tool 20 could be conveyed by wire-line, drill-pipe, tubing or any other means used in the industry. For the sake of brevity and clarity, only a portion of the components of the tool 20 are depicted in FIG. 2.

The testing tool 20 comprises a plurality of modules that may be assembled together prior to lowering the testing tool. For example, in the embodiment shown in FIG. 2, the testing tool comprises a testing module 20*a* depicted in a sampling position, a packer module 20*b* including an inflatable packer 30 depicted in an extended or sealing position, and a hydraulic power module 20*c*. The modules in FIG. 2 may be arranged in the different manner, and/or one or more of the components in each module may be arranged or grouped differently than as shown in FIG. 2.

The testing module 20*a* comprises a probe 21 defining a sampling port or inlet of the testing tool. In its extended position, the probe 21 is pressed against a wall of the wellbore 11 with setting pistons 24. When set, the probe 21 sealingly engages a wall of the wellbore 11, thereby establishing an exclusive fluid communication between the formation 10 and a flow line 28 of the testing tool 20.

The testing module 20*a* comprises one or more syringe pumps fluidly connected to the flowline 28 and configured to draw fluid from the formation. In FIG. 2, two syringe pumps are implemented with vessels 30*a* and 30*b*, each of which includes a piston slidably disposed therein. The flow of fluid in the flow line 28 to and/or from the vessels 30*a* and 30*b* is controlled by valves 35*a* and 35*b*, respectively. The valves 35*a* and 35*b* may be selectively opened for receiving formation fluid therein, and may be closed once a fluid has been collected in the vessels 30*a* and 30*b*, respectively. By closing the valves 35*a* and 35*b*, the sample collected in the vessels 30*a* and 30*b*, respectively, may be isolated from the flow line 28 for transporting the sample to the surface.

For sampling some reservoirs, such as heavy oil or bitumen reservoirs, the testing module 20*a* may comprise means 25 for mobilizing the hydrocarbon in the formation 10. The hydrocarbon mobilizing means 25 may comprise a heat source configured to deliver heat to the formation. The hydrocarbon mobilizing means 25 may comprise or be selected from ultrasonic sources, micro-wave source, induction coils, and galvanic current electrodes. For example, the hydrocarbon mobilizing means 25 may comprise heating pads and electromagnetic transducers, as discussed above with respect to FIG. 1.

The testing module 20*a* may further comprise one or more instruments (e.g., a viscometer, a thermometer, and a densitometer, among others) configured to measure fluid properties. Such instruments may be located on the probe 21 for extension toward the wellbore wall, on the flowline 28, or in the vessels 30*a*, 30*b*. The testing module 20*a* may also comprise a heat pump (not shown) thermally coupled to the vessels 30*a* and 30*b* for varying the temperature of the fluid samples therein and optionally determine a formation fluid characteristic (e.g., viscosity) as a function of temperature.

To provide hydraulic power to the testing tool 20, the testing tool 20 comprises a hydraulic line 40 that is connected to a pump 44 and a hydraulic reservoir, both disposed in the hydraulic module 20*c*. The hydraulic line 40 may be provided with a pressure sensor 41 for monitoring and controlling the pressure of the hydraulic fluid therein.

The hydraulic line 40 is connected to the back of the vessels 30*a* and 30*b* through valves 32*a* and 32*b* respectively. To draw formation fluid from the vessel 30*a*, the pressure in the flow line 40 may be lowered to at least below the formation pressure, in some cases with a minimal decrease in pressure with respect to the formation pressure. The valve 32*a* (e.g., a needle valve) may then be opened to control the flow-rate of hydraulic fluid leaving the vessel 30*a*, and consequently, the movement of the piston disposed in the vessel 30*a*. Fluid, e.g., mobilized fluid, may thus be extracted from the formation and enter the vessel 30*a*. Controlling at least one of the pressure and the flow rate in the flow line 40 as fluid enters a vessel may insure that the received sample is representative of the formation substance, so that the sample can be used to determine the chemical and physical properties to assist with the definition of a suitable production strategy. In addition, controlling the pressure of the captured sample may insure that the sample remains representative of the formation substance during transportation of the sample to the surface.

The hydraulic line 40 is also connected to the back of the tank 50 through valve 51, which are configured to convey a packer inflation fluid (e.g., water). To inflate (deflate) the packer 30, the pressure in the flow line 40 is increased (decreased) to a level above (below) the wellbore pressure, in some cases with a minimal increase (decrease) in pressure with respect to the wellbore pressure. The valve 51, is opened to control the flow-rate of hydraulic fluid entering (leaving) the tank 50 and, consequently, the inflation (deflation) of the packer 30.

The packer module 20*b*, located above the testing module 20*a* in the embodiment shown in FIG. 2, is configured to provide a barrier having the purpose of reducing heat convection in the wellbore. The packer structure may be similar to the structure of known packers used in traditional testing tools (e.g., an inflatable packer). However, the packer does not need to maintain a pressure difference across it. The packer may be fabricated from a material capable of surviving high temperature for time periods on the order of days. The packer may comprise an elastomeric membrane disposed between a fixed collar and a sliding collar on the packer module 20*b*. The packer may be reinforced by metallic slats covering the elastomeric membrane (not shown). The packer may also comprise a retraction mechanism configured to assist the retraction of the packer as it is deflated (not shown). Examples of retraction mechanisms may be found in U.S. Pat. No. 7,392, 851. While an inflatable packer is described therein, other types of packer may alternatively be used, such a compression packers.

Figure 3:
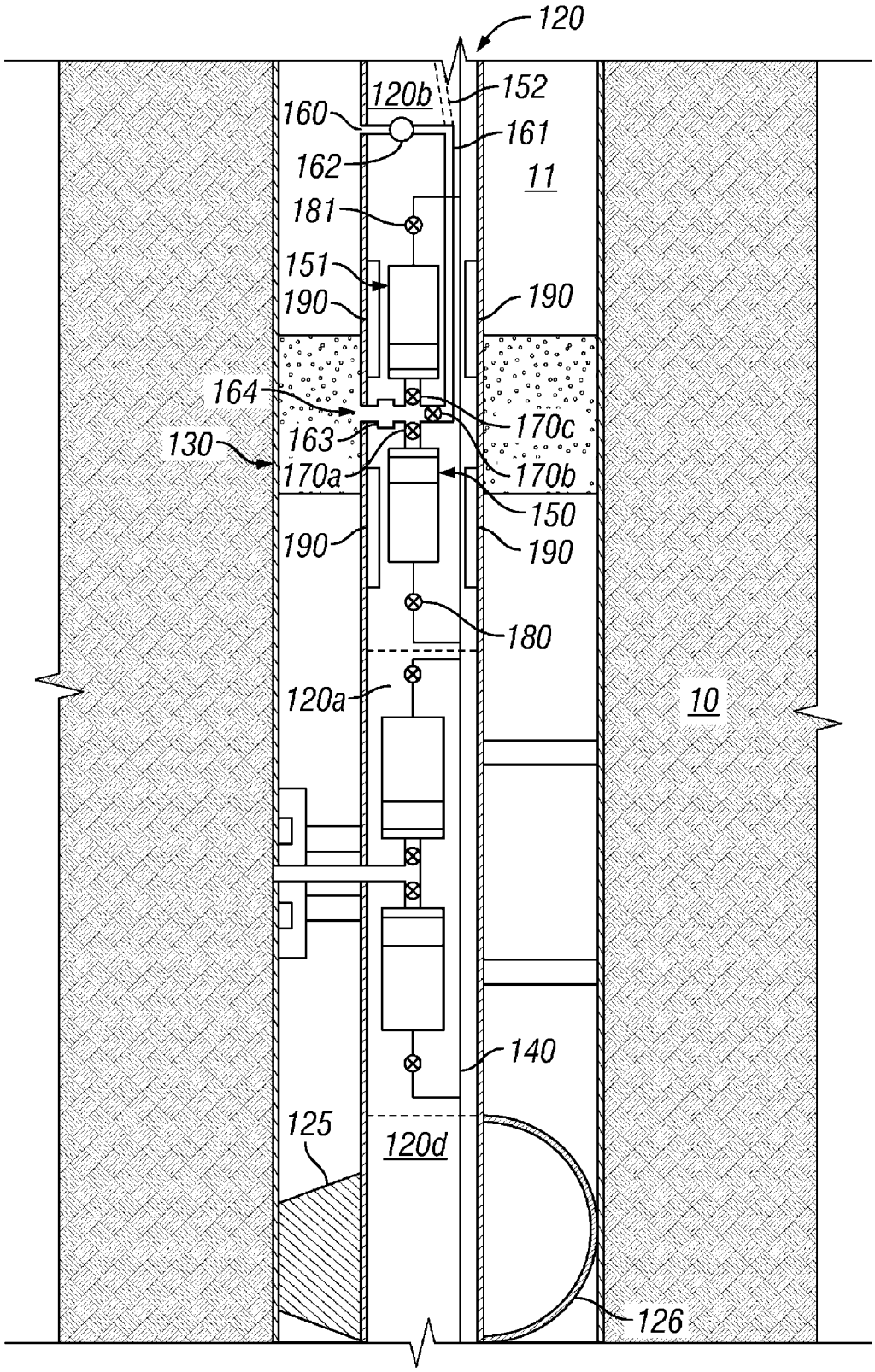
FIG. 3 is a schematic view of at least a portion of an apparatus according to one or more aspects of the present disclosure.

Referring to FIG. 3, illustrated is a schematic view of at least a portion of a testing tool 120 lowered in a wellbore 11. The tool 120 is capable of providing a chemical packer for reducing heat convection in the well during fluid evaluation operations. The tool 120 could be conveyed by wire-line, drill-pipe, tubing or any other means used in the industry. For the sake of brevity and clarity, only a portion of the components of the tool 120 are depicted in FIG. 3. For example, the tool 120 may further comprise a hydraulic power module similar to the hydraulic power module 20*c* shown in FIG. 2, and configured to vary the pressure in a hydraulic flow line 140.

The testing tool 120 may comprise a plurality of modules that may be assembled together prior to lowering the testing tool. For example, in the embodiment shown in FIG. 3, the testing tool comprises a testing module 120*a* depicted in a sampling position, a chemical packer module 120*b* depicted with a set chemical packer 130, and a heating module 120*d*. The modules in FIG. 3 may be arranged in a different manner, and/or one or more of the components in each module may be arranged or grouped differently than as depicted in FIG. 3. For example, the heating module 120*d* may be disposed below the chemical packer module 120*b* and above the testing module 120*a*. This alternative configuration may provide better efficiency for heating a portion of the formation 10. However, this alternative configuration may require moving the testing tool to align a probe provided in the testing module 120*a* with the heated portion of the formation.

The testing module 120*a* may be substantially similar or identical to the testing module 20*a* of FIG. 2. However, as shown in FIG. 3, the hydrocarbon mobilizing means 125 are located in a separate heating module 120*d*. The hydrocarbon mobilizing means 125 include a heat source configured to deliver heat to the formation. The hydrocarbon mobilizing means 125 may comprise or be selected from ultrasonic sources, micro-wave source, induction coils, and galvanic current electrodes. For example, the hydrocarbon mobilizing means 125 may comprise heating pads and electromagnetic transducers, as discussed above with respect to FIG. 1. In FIG. 3, the hydrocarbon mobilizing means 125 are pressed against the formation 10 with a bow spring 126 located on an opposite side of the heating module 120*d*. Pressing the heating pads against the formation reduces the distance between the heat source and the formation to be heated. As a consequence, heat convection in the wellbore may be significantly reduced, as indicated in Equation 1 by the representative length L at a cubic power.

The chemical packer module 120*b*, disposed above the heating module 120*d*, is configured to provide a barrier having the purpose of reducing heat convection in the wellbore. To convey gelling agents, de-gelling agents, drilling fluid, or additives, the chemical packer module 120*b* is provided with a plurality of tanks, such as pressurized tanks 150 and 151. Alternatively, gelling agents, de-gelling agents, or other fluid having downhole use may be provided from a surface via a stream 152 (e.g., when the testing tool is conveyed downhole by a work string or tubing). The total volume of the tanks 150 and 151 may be configured to provide the total volume of gel around the tool sufficient for effectively reducing heat convection. The total volume of gelling agent that may be used to obtain a suitable gel can vary between 1 and 20% of the required packer volume around the tool. For example, suitable volumes for the pressurized tanks 150 and 151 may vary between 2 and 40 gallons.

When used in water based wellbore fluid, the tanks 150, 151 may be filled with a natural polysaccharide based concentrate, a biopolymer based concentrate, a synthetic polymer based concentrate, a viscoelastic surfactant, or a surfactant. When used in oil based wellbore fluid, the tanks 150, 151 may comprise an oil based gelling agent, such as a phosphor based gelling agent, and a pH activator. When an emulsion or a foam of the gel is desired, the tanks 150, 151 may comprise an immiscible liquid phase (for example, oil for a water based weighted fluid), a gas phase (e.g., nitrogen), or a supercritical phase (e.g., supercritical CO2). The tank may further comprise various additives and/or de-gelling agents as further detailed with respect to FIG. 4.

To mix gelling agent with the wellbore fluid, the chemical packer module 120*b* may be provided with a mud intake 160, located for example above the chemical packer 130, a mud flowline 161 fluidly coupled to the intake 160 and a mud pump 162 (e.g., a reciprocating or centrifugal pump) operatively coupled to the flow line 161. Alternatively, wellbore or workover fluids (e.g., filtered drilling fluid) may be provided from a surface via stream 152. Also, the major component of the gel, such as brine, a fluid similar to the wellbore fluid, or gas, may be contained in one of the tanks 150, 151, and the gelling agent may be contained in the other tank.

To control the proportion of the chemical being mixed downhole, the chemical packer module 120*d* is provided with control valves 170*a*, 170*b*, 170*c*. In addition, the hydraulic line 140 is also connected to the back of the tanks 150 and 151 through the valves 180 and 181 respectively. To set the chemical packer 130, the pressure in the flow line 140 is increased to a level above the wellbore pressure. The valves 180 and 181 may be opened for controlling the flow rate of the gelling agents conveyed in the tanks 150 and 151 towards the outlet 164. To mix gelling agent together and or mix gelling agent with wellbore fluid, the chemical packer module is provided with an inline mixing device 163, such as a static mixer or a series of orifices configured to mix the different fluids. The gel may be pumped into the wellbore about a circumference of the testing tool above the heater through one or more tool outlets 164.

The packer module 120*b* may be configured to dissolve the chemical packer, if desired. In doing so, the testing tool 120 may be freely moved to another location in the well or out of the well. Thus, the gelling reaction may be reversible to the extent the gel reverts to a liquid by suitable chemical degradation reactions resulting in a decrease of the gel viscosity and mechanical properties. In one example, a de-gelling agent (e.g., an acid, base, and/or saline solution) may be conveyed in one of the tanks 150, 151 and delivered in the wellbore at the outlet 164. In another example, the mixed liquids form a gel that can be returned to the liquid state by delayed chemical reactions. Alternatively, when using shear-thinning fluids, the gel may be reverted to a liquid by the application of mechanical agitation. For example, the mechanical agitation of the gel may be provided by moving plates, acoustic or ultrasonic signals emitted from agitator(s) 190 located near the outlet 164. Alternatively, physicochemical conditions may be varied to change the gel to a fluid, such as by application of electrical potentials or electromagnetic waves, application of pressure changes, and/or application of temperature changes, among other possibilities.

While only one packer located above the tool heater is shown in FIGS. 2 and 3, it should be appreciated that two or more packers may advantageously used. For example, a second packer may be located below the tool heater and be used to further reduce heat convection and/or conduction in the wellbore.

Figure 4:
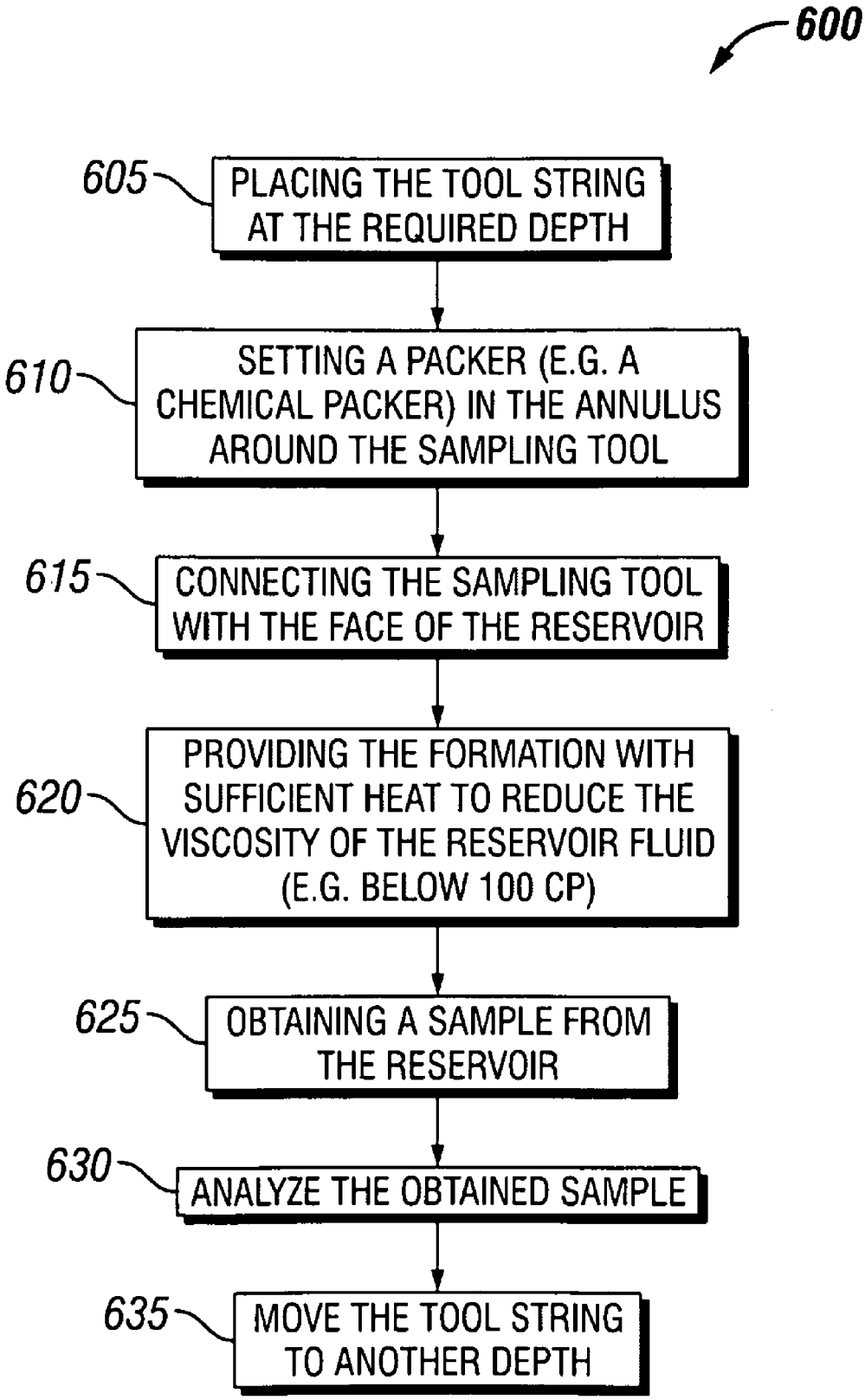
FIG. 4 is a flow chart diagram of at least a portion of a method according to one or more aspects of the present disclosure.

FIG. 4 is a flow chart diagram of at least a portion of a method 600 for evaluating hydrocarbon fluid via formation heating. In method 600, a packer is set preferably above a heater of a downhole testing tool to reduce heat convection that may occur during heating the formation. Thus, the thermal insulation provided by the packer may enable and/or expedite the mobilization of formation fluid with a downhole heat source having a limited power. The method 600 may be executed using the testing tool 20 of FIG. 2 and/or the testing tool 120 of FIG. 3, among others within the scope of the present disclosure.

To evaluate hydrocarbon reservoirs, a testing tool may be conveyed downhole at a step 605. The testing tool may be conveyed by wire-line, drill-pipe, tubing or any other means used in the industry. The testing tool may be provided with a packer (e.g., the inflatable packer 30 of FIG. 2). The testing tool may also or alternatively be capable of setting a chemical packer (e.g., chemical packer 130 of FIG. 3), consisting for example of a high viscosity gel.

When a sampling port of the testing tool is located at the depth at which a hydrocarbon is to be tested, the testing tool may be anchored (e.g., with setting piston 24 in FIG. 2). At step 610, a packer may be set to isolate an annulus around the testing tool and to provide a heat convection barrier. If a mechanical packer is used, this step may comprise extending the mechanical packer towards the wellbore wall. Alternatively, a chemical packer may be used. The chemical packer may be provided with a gel that may be formed from a reaction that occurs when two or more fluids are mixed. In this case, one or various concentrated liquid or gas components (that have low viscosities, typically less than 10 cP) are mixed with the wellbore fluids to form a gel and/or increase the viscosity of a portion of the wellbore fluid. The gel may be pumped into the wellbore about a circumference of the testing tool above the heater. Depending on the nature of the wellbore fluid (aqueous or oil based mud), the density, the time the gel is required to reduce fluid convection, and the bottom hole static temperature, the choice of gel can be different, ranging from polysaccharide based, synthetic polymer based, or surfactant based aqueous fluids, to oil gellants. Other examples of the gel include shear thinning fluid similar to those employed for well services applications such as fracturing, acidizing, acid fracturing, gravel packing or work over fluids. Optionally, a second packer may be set below above the heater of the downhole testing tool for further reducing heat convection or conduction that may occur during heating the formation Subsequently, at step 615, a probe may be extended toward the wellbore wall, thereby fluidly connecting the testing tool with the face of the reservoir. The method 600 may proceed with steps 620, 625 and 630, similarly to steps 520, 525 and 530 of method 500. In the example method 600, the packer set (e.g., an inflatable or a chemical packer) at step 610 reduces heat convection that may occur during the step 620.

At step 635, if a mechanical packer is used, the mechanical packer is retracted towards the testing tool. Alternatively, if a chemical packer is used, the mixed liquids form a gel that can be returned to the liquid state by delayed chemical reactions resulting in a decrease of the gel viscosity and mechanical properties, or by the application of mechanical agitation. Mechanical agitation could be provided by moving plates or preferably acoustic or ultrasonic signals near the chemical packer.

For illustration purposes, various formulations of chemical packers are described below in more details.

EXAMPLE 1

Chemical Packers Obtained by Gellation of Water Based Wellbore Fluids with Polymers Aqueous wellbore fluids can be gelled by admixing the wellbore fluids with a polymer concentrate. Suitable polymers can be selected from:

i) water soluble natural polysaccharides and chemical modifications thereof such as guar, starch, hydroxyethyl cellulose, hydroxypropyl guar, carboxymethyl hydroxypropyl guar, cationic guar, and the like;

ii) water soluble biopolymers such as xanthan, diutan, wellam, and the like; and iii) water soluble synthetic polymers such as those obtained by copolymerization of acrylamide, acrylic acid, maleic acid, AMPS, MADQUAD, DADMAC, vinyl sulfonate, styrene sulfonate, and the like.

The polymer concentrate can be a totally, partially, or minimally solvated solution or dispersion of the polymer in a suitable solvent. Suitable solvents are water, aqueous brines, heavy brines, agents of water and water soluble organic solvents, polar organic solvents such as methanol, isopropanol, 2-butoxy ethanol, water insoluble organic solvents, diesel, kerosene, mineral spirits, and the like. The concentrate can further comprise suitable dispersing, hydrating aids or solvating agents such as surfactants, clays, or acids.

In addition to the polymer concentrate, other chemical additives capable of altering the mechanical strength of the chemical packer by means of chemical reactions (crosslinking) or physical association can be utilized. These additives can be also part of the polymer concentrate, or be added to the wellbore fluid in a different stream. Suitable additives for the chemical packer can be selected from:

i) basic pH activators (such as sodium hydroxide, potassium hydroxide, sodium bicarbonate, sodium carbonate, amines, and agents thereof);

ii) acid pH activators (such as hydrochloric acid, acetic acid, sodium acetate, and agents thereof);

iii) metal crosslinkers (such as borate crosslinkers, zirconium crosslinkers, titanium crosslinkers, aluminum crosslinkers, calcium crosslinkers);

iv) heat stabilizers (such as tertiary amines, hydroxyl amines, sodium thiosulfate);

v) oxidative breakers (such as persulfates, bromates, chlorates, organic peroxides, and agents thereof);

vi) acids breakers (such as inorganic acids, organic acids, polymeric and latent acids);

vii) oligomeric breakers;

viii) delay agents for crosslinking and/or breaking;

ix) chelants; and x) solids such as fibers, platelets, spheres, and/or other particulates.

EXAMPLE 2

Chemical Packers Obtained by Gellation of Water Based Wellbore Fluids with Surfactants Aqueous wellbore fluids can be gelled by admixing the wellbore fluids with a surfactant concentrate. The aqueous fluid may be or comprise water, brine, heavy brine, and/or others. Surfactants that can be selected as suitable gelling agents for the chemical packer include cationic amphoteric, zwitterionic and anionic cleavable surfactants for example as described in U.S. Pat. No. 7,036,585.

In addition to the surfactant concentrate, other chemical additives capable of altering the mechanical strength of the chemical gel packer by means of chemical reactions or physical association can be utilized. These additives can be also part of the surfactant concentrate, or be added to the wellbore fluid in a different stream. Suitable additives for the chemical packer can be selected from:

i) brines, such as concentrated potassium chloride, calcium chloride, sodium chloride, calcium bromide and the like;
ii) a separate phase (an immiscible liquid, such as an oil, a supercritical fluid, such as supercritical CO2, or a gas such as nitrogen or compressed air), for obtaining a stable emulsion or a foam with the wellbore fluid;
iii) rheology modifiers, such as low molecular weight polyethylenoxide copolymers, partially hydrolyzed polyvinyl acetate copolymers, and the like;
iv) shear recovery agents, such as ether containing alcohols, sulfonate containing copolymers;
v) counterions, such as sodium salicilate and the like;
vi) viscoelastic surfactant breakers;
vii) chelants; and
viii) solids such as fibers, platelets, spheres and/or other particulates.

EXAMPLE 3

Chemical Packers Obtained by Gellation of Oil Based Wellbore Fluids

Oil based wellbore fluids can be gelled by admixing the wellbore fluids with a gelling agent concentrate. Compounds that can be selected as suitable gelling agents for the chemical packer are molecules capable of forming long range structures in the oil solvent such as sodium acetate activated phosphorous organic esters, a pH activator, or an oil based gelling agent, such as a phosphor based gelling agent.

EXAMPLE 4

Chemical Packers Obtained with a Polymer Based Foam

Low molecular weight reactive polymers can be foamed and crosslinked to obtain a solid foam of the required consistency, by displacement of the reaction products in gas form, or by co-injection with suitable gases (such as nitrogen, carbon dioxide or air) or compounds that are gases at the temperatures and pressures present downhole such as pentane. Suitable polymers can be selected from thermoplastics such as polystyrene, polyethylene, polypropylene, polycarbonate, or thermo sets such as epoxy resins and polyurethane resins.

In view of the above and the FIGS. 1-4, it will be appreciated that the present disclosure introduces improved downhole formation testing tools and methods capable of expediting the downhole evaluation of formation fluids via formation heating. More particularly, the improved downhole formations testing tools and methods may provide wellbore insulation for reducing the natural heat convection in the well that arises from increasing the formation temperature.

For example, the present disclosure introduces a method for evaluating hydrocarbon fluid that includes lowering a testing tool in a wellbore formed in a subterranean formation, sealing a wellbore annulus at a first depth with the testing tool thereby limiting wellbore fluid convection, heating a portion of the formation near the first depth, and evaluating at least a portion of the hydrocarbon heated in the formation.

The present disclosure also introduces a method for evaluating hydrocarbon fluid that includes lowering a testing tool in a wellbore formed in a subterranean formation, increasing a viscosity of at least a portion of a wellbore fluid with the testing tool thereby limiting wellbore fluid convection, heating a portion of the formation, and evaluating at least a portion of the hydrocarbon heated in the formation.

The present disclosure also introduces an apparatus for evaluating hydrocarbon fluid in a wellbore formed in a subterranean formation, wherein the apparatus comprises a tool body configured to be lowered in the wellbore, the tool body having a heater for increasing the temperature of a portion of the subterranean formation and means for reducing heat convection in the wellbore.

The present disclosure also introduces a method of evaluating a subterranean formation fluid comprising lowering a testing tool in a wellbore formed in a subterranean formation, sealing a wellbore annulus at a depth with the testing tool, and heating formation fluid in the subterranean formation near the depth. A sample of the heated formation fluid is then obtained from the subterranean formation. At least a portion of the sample of heated formation fluid obtained from the subterranean formation is then evaluated. Sealing the wellbore annulus at the depth with the testing tool may limit wellbore fluid convection. Evaluating at least a portion of the sample may be conducted at or near the depth within the wellbore. Evaluating at least a portion of the sample may comprise operating the testing tool to perform the evaluation. Evaluating at least a portion of the sample may comprise operating the testing tool to perform the evaluation at or near the depth within the wellbore. The depth may be a first depth, and the method may further comprise moving the testing tool to a second depth in the wellbore and repeating the sealing, heating, obtaining, and evaluating steps at the second depth. The depth may be a first of a plurality of depths within the wellbore, and the method may further comprise repeating the lowering, sealing, heating, obtaining, and evaluation steps at each of the other ones of the plurality of depths.

The present disclosure also introduces a method of evaluating a subterranean formation fluid comprising lowering a testing tool in a wellbore formed in a subterranean formation, increasing a viscosity of at least a portion of a wellbore fluid near a depth with the testing tool, and heating formation fluid in the subterranean formation near the depth. A sample of the heated formation fluid is then obtained from the subterranean formation. At least a portion of the sample of heated formation fluid obtained from the subterranean formation is then evaluated. Increasing the viscosity of at least a portion of the wellbore fluid may limit wellbore fluid convection. Evaluating at least a portion of the sample may be conducted at or near the depth within the wellbore. Evaluating at least a portion of the sample may comprise operating the testing tool to perform the evaluation. Evaluating at least a portion of the sample may comprise operating the testing tool to perform the evaluation at or near the depth within the wellbore. The depth may be a first depth, and the method may further comprise moving the testing tool to a second depth in the wellbore and repeating the sealing, heating, obtaining, and evaluating steps at the second depth. The depth may be a first of a plurality of depths within the wellbore, and the method may further comprise repeating the lowering, sealing, heating, obtaining, and evaluation steps at each of the other ones of the plurality of depths.

The present disclosure also introduces an apparatus for evaluating a subterranean formation fluid, comprising: means for heating formation fluid within the subterranean formation near a depth to which the apparatus is lowered within a wellbore extending into the subterranean formation; means for reducing heat convection in the wellbore while the formation fluid is heated within the subterranean formation; means for obtaining a sample of heated formation fluid from the subterranean formation near the depth; and means for evaluating at least a portion of the sample. The evaluating means may comprise means for evaluating at least a portion of the sample at or near the depth within the wellbore. The heating means may be further configured to heat formation fluid within the subterranean formation near a second depth to which the apparatus is lowered within the wellbore after the first sample of heated formation fluid is obtained. The heat convection reducing means may be further configured to reduced heat convection in the wellbore while the formation fluid is heated within the subterranean formation near the second depth. The obtaining means may be further configured to obtain a second sample of heated formation fluid from the subterranean formation near the second depth. The evaluating means may be further configured to evaluating at least a portion of the second sample. The evaluating means may comprise means for evaluating at least a portion of the second sample at or near the second depth within the wellbore. The heat convection reducing means may be configured to prevent flow in at least a portion of the wellbore. The heat convection reducing means may also or alternatively comprise at least one mechanical packer. The heat convection reducing means may also or alternatively comprise at least one chemical packer selected from the group consisting of: chemical packers obtained by gellation of water based wellbore fluids with polymers, chemical packers obtained by gellation of water based wellbore fluids with surfactants, chemical packers obtained by gellation of oil based wellbore fluids, and/or chemical packers obtained with a polymer based foam. The heat convection reducing means may also or alternatively comprise at least one chemical packer formulation which comprises crosslinkers, catalysts and chemicals required to set the packer and chemicals required to unset or break the chemical packer.

The foregoing outlines features of several embodiments so that those skilled in the art may better understand the aspects of the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions and alterations herein without departing from the spirit and scope of the present disclosure.

What is claimed is:

1. A method of evaluating a subterranean formation fluid, comprising:

lowering a testing tool in a wellbore formed in a subterranean formation;

reducing heat convection in the wellbore by increasing a viscosity of at least a portion of a wellbore fluid near a depth with the testing tool;

heating formation fluid in the subterranean formation near the depth;

obtaining a sample of the heated formation fluid from the subterranean formation; and evaluating at least a portion of the sample of heated formation fluid obtained from the subterranean formation.

2. The method of claim 1 wherein increasing the viscosity of at least a portion of the wellbore fluid limits wellbore fluid convection.

3. The method of claim 1 wherein evaluating at least a portion of the sample is conducted at or near the depth within the wellbore.

4. The method of claim 1 wherein evaluating at least a portion of the sample comprises operating the testing tool to perform the evaluation.

5. The method of claim 1 wherein evaluating at least a portion of the sample comprises operating the testing tool to perform the evaluation at or near the depth within the wellbore.

6. The method of claim 1 wherein the depth is a first depth, and wherein the method further comprises:

moving the testing tool to a second depth in the wellbore; and repeating the sealing, heating, obtaining, and evaluating steps at the second depth.

7. The method of claim 1 wherein the depth is a first of a plurality of depths within the wellbore, and wherein the method further comprises repeating the lowering, sealing, heating, obtaining, and evaluation steps at each of the other ones of the plurality of depths.

8. The method of claim 1 wherein:

increasing the viscosity of at least a portion of the wellbore fluid limits wellbore fluid convection;

evaluating at least a portion of the sample comprises operating the testing tool to perform the evaluation at or near the depth within the wellbore;

the depth is a first of a plurality of depths within the wellbore; and the method further comprises repeating the lowering, sealing, heating, obtaining, and evaluation steps at each of the other ones of the plurality of depths.

* * * * *